United States Patent [19]

Kuchenbecker

[11] 4,133,429

[45] Jan. 9, 1979

[54] PACKAGE STRUCTURE

[75] Inventor: Morris W. Kuchenbecker, Neenah, Wis.

[73] Assignee: American Can Company, Greenwich, Conn.

[21] Appl. No.: 904,375

[22] Filed: May 10, 1978

[51] Int. Cl.[2] ..... B65D 73/00

[52] U.S. Cl. ..... 206/465; 206/468

[58] Field of Search ..... 206/461–465, 206/467–470

[56] References Cited

U.S. PATENT DOCUMENTS

| | | | |
|---|---|---|---|
| 3,104,759 | 9/1963 | Hansen | 206/464 X |
| 3,157,280 | 11/1964 | Perdue et al. | 206/468 |
| 3,326,370 | 6/1967 | Riestenberg | 206/464 X |
| 3,326,371 | 6/1967 | Riestenberg | 206/464 X |
| 3,464,544 | 9/1969 | Franck | 206/468 |
| 3,467,248 | 9/1969 | Makowicki | 206/464 X |
| 3,812,963 | 5/1974 | Zahuranec et al. | 206/468 |

FOREIGN PATENT DOCUMENTS

| | | | |
|---|---|---|---|
| 1570711 | 6/1969 | France | 206/470 |
| 425617 | 6/1967 | Switzerland | 206/470 |
| 1384547 | 2/1975 | United Kingdom | 206/468 |

*Primary Examiner*—Steven E. Lipman

*Attorney, Agent, or Firm*—Robert P. Auber; Ira S. Dorman; Harry W. Hargis, III

[57] ABSTRACT

A reclosable blister card package comprises a plastic blister having a flanged portion and a raised product holding portion. A paperboard card is folded over at least a pair of opposed blister flanged portions in provision of sliding movements of the blister on the card. A portion of the card extending transversely of the direction of sliding movements is folded over to present an edge thereof in engagement with a correspondingly extending portion of the flanged portion of the blister. A crease is provided in the card parallel to and adjacent the edge of the folded portion to accommodate pivotation of the edge out of engagement with the flanged portion and consequent release of the card from the blister in provision of access to a product held therein.

5 Claims, 6 Drawing Figures

PACKAGE STRUCTURE

BACKGROUND OF THE INVENTION

This invention relates to packaging structure, and more particularly to improvements in blister card packages of the reclosable type.

While reclosable blister card packages have attained wide acceptance, difficulties have been encountered in providing both economical and effective locking means for maintaining reclosure of a package of this type once it has been opened. Known locking means heretofore have required provision of specially shaped tabs, slots, as well as built-up cards to serve as the operating lock elements.

The following is a listing of U.S. Patents believed material to the examination of this application, together with a concise explanation of the relevance of each:

No. 3,157,280 discloses slide-defining flanges 24, 25 on a plastic blister 3 slidable on backing member 2. Locking tabs 29, 30 on member 2 releasably engage flanges 21, 22 on blister 3.

No. 3,174,621 discloses a blister 14 adhesively bonded to a card portion 20 by adhesive dots 26 that are releasable to accommodate pivotation of portion 20 in provision of access to the contents of the blister. Relocking is afforded by pivoting locking tongue 24 over flange 16' of blister 14.

No. 3,326,370 discloses a blister 10 provided with flanges 19 slidable in folded side flanges 52, 53 on a card 12. A cut-out tab 58 on card 12 locks the blister in position, and is releasable by folding card portion 24.

No. 3,326,371 discloses structure similar to that of the '370 patent.

No. 3,464,544 discloses a card defining channels for sliding retention of blister flanges, and locking detents therein.

No. 3,467,248 discloses a card defining channels for blister flanges, and a cut-out locking tab 42 in the card.

No. 3,792,181 discloses a folded locking flange 92 (FIGS. 9, 10) on a blister to accommodate pivotal opening of a cover having a flange 94 retained by flange 92.

No. 3,812,963 discloses sliding cover 12 and base 11, and locking means including apertures 14 for receiving detents 39, 40.

No. 3,896,933 discloses blister and base means relatively slidable and locked by detent means 1*d*, 2*b*.

It is a general objective of the invention to provide improved reclosable blister card package structure affording both economy and effectiveness of relocking construction.

SUMMARY OF THE INVENTION

In achievement of the foregoing as well as other objectives and advantages, the invention contemplates a reclosable blister card package, comprising: a plastic blister having a flanged portion and a raised product holding portion; a paperboard card releasably affixed to a first part of said flanged portion; a portion of said card folded over to present an edge thereof in engagement with a second part of said flanged portion of said blister; and said card being bendable along a line extending in substantially parallel relationship to said edge of said folded portion so as to accommodate pivotation of said edge out of engagement with said second part of said flanged portion, and consequent release of said card from said blister in provision of access to the interior of said package.

The manner in which the foregoing as well as other objectives and advantages of the invention may best be achieved will be more fully understood from a consideration of the following description, taken in light of the accompanying drawing.

DESCRIPTION OF THE PREFERRED EMBODIMENTS

Figure 1:
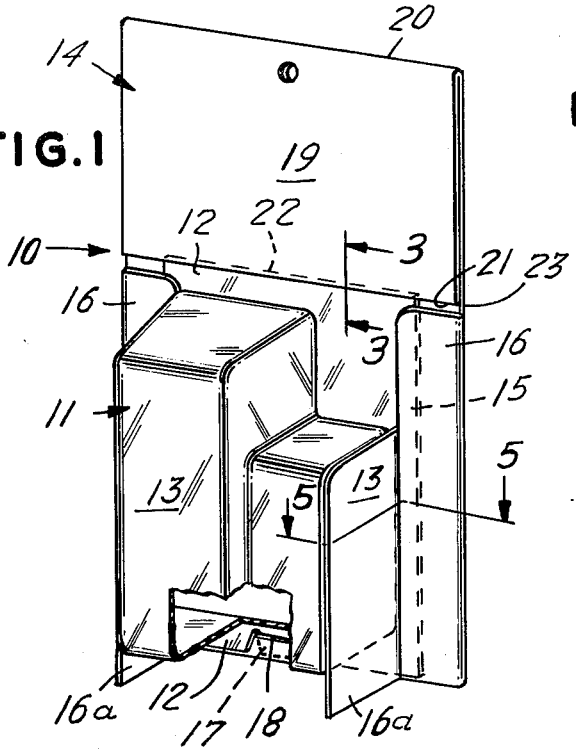
FIG. 1 is a perspective showing of a blister card package embodying the invention.
Figure 5:
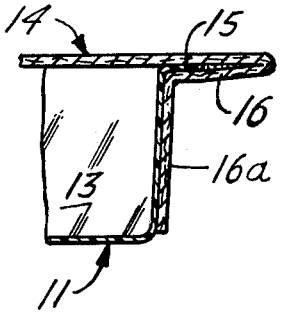
FIG. 5 is a sectional view, on an enlarged scale, taken in the plane of line 5—5 in FIG. 1, as seen looking in the direction of arrows applied thereto.

With more particular reference to the drawing and first to FIG. 1, a reclosable blister card package 10 of generally rectangular configuration comprises a plastic blister 11 having a flanged portion 12 and a raised product holding portion 13. As is seen also in FIG. 5, a paperboard card 14 is releasably affixed to a first part 15 of flanged portion 12 by folded tab means 16 on the card partially adhered to the latter and extending over and slidably engaging part 15 of flanged portion 12. A tab 17 formed in a lower, transversely extending part of flanged portion 12 is received within a slot 18 in card 14 to prevent the blister from sliding from between folded tab means 16 and off the lower end of the card.

Figure 2:
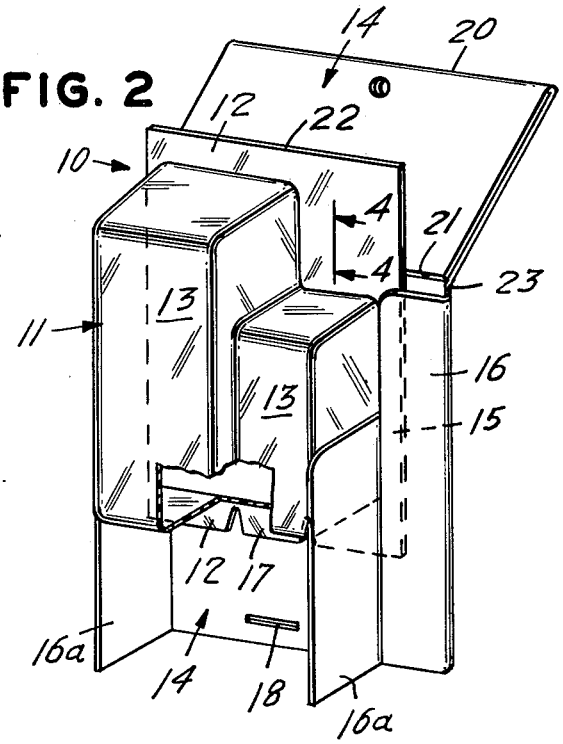
FIG. 2 is a view similar to FIG. 1, and illustrating an operational feature of the invention.
Figure 3:
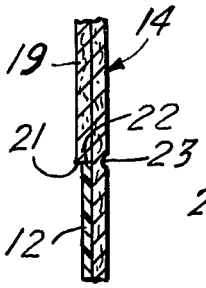
FIG. 3 is a sectional view, on an enlarged scale, taken in the plane of line 3—3 in FIG. 1, as seen looking in the direction of arrows applied thereto.
Figure 4:
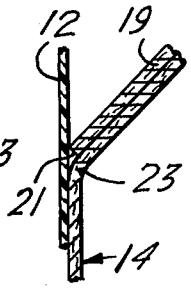
FIG. 4 is a sectional view, on an enlarged scale, taken in the plane of line 4—4 in FIG. 2, as seen looking in the direction of arrows applied thereto.

In particular accordance with the invention, and with reference also to FIG. 3, a package opening and reclosure feature is afforded by a portion 19 of card 14 extending transversely of the direction of sliding movements and folded over at 20 and adhered to underlying portions of card 14 to present an edge 21 in abutting engagement with a correspondingly extending second part 22 of flanged portion 12 of blister 11. A crease 23, such as, for example a score line, is provided in card 14 parallel to and adjacent the edge 21 of the folded portion 19, and, as is seen in FIGS. 2 and 4, accommodates bending of the card and pivotation of the edge 21 out of engagement with the second part 22 of flanged portion 12, and consequent sliding release of the blister from the card in provision of access to a product held in the package. It will be appreciated that, particularly upon reclosure, a slight gap may exist between the locking edge 21 and the card over which it extends, which gap may receive a small portion of blister flange part 22 in provision of overlapped locking engagement.

As is seen also to advantage in FIG. 1, each tab means 16 includes a portion **16*a* projecting from the plane of card 14, preferably at right angles thereto, on the side to which blister 13 is affixed. Lower end regions of portions 16*a* and of the card 14 are so cooperably disposed as to provide support for package 10** in the illustrated upright position on a planar surface (not shown).

Figure 6:
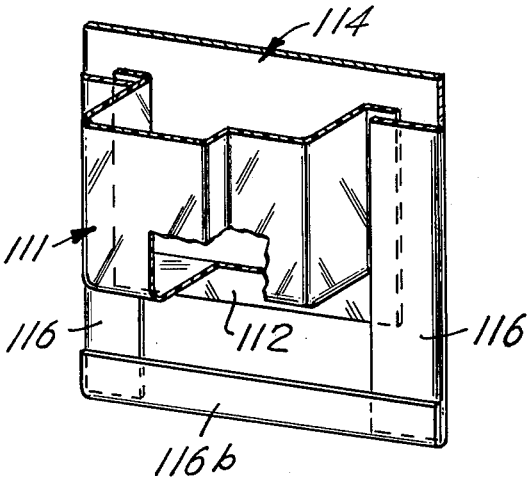
FIG. 6 is a fragmentary view similar to FIG. 2, and illustrating a modified embodiment of the invention.

The invention comtemplates also that instead of tab 17 and slot 18, as seen in FIGS. 1 and 2, a transversely extending tab **116*b* as seen in FIG. 6, may be provided on card 114 and folded over to receive the correspondingly disposed lower flange 112 of blister 111 to prevent sliding of the blister from the lower ends of folded tabs 116**.

It will be appreciated that the invention affords improved reclosable blister card package structure affording both economy and effectiveness of relocking construction.

While the description and the accompanying drawing are illustrative of preferred embodiments of the invention, it will be recognized that other changes may be made without departing from the scope of the appended claims.

I claim:

1. A reclosable blister card package, comprising: a plastic blister having a flanged portion and a raised product holding portion; a paperboard card releasably affixed to a first part of said flanged portion; a portion of said card folded over to present an edge thereof in engagement with a second part of said flanged portion of said blister; and said card being bendable along a line extending in substantially parallel relationship to said edge of said folded portion so as to accommodate pivotation of said edge out of engagement with said second part of said flanged portion, and consequent release of said card from said blister in provision of access to the interior of said blister.

2. The combination according to claim 1, and characterized in that said card and said first part of said flanged portion are releasably affixed by folded tab means provided on said card extending over said first part of said flanged portion and affording relative sliding movements between said blister and said card upon the recited pivotation of said edge out of engagement with said second part of said flanged portion.

3. The combination according to claim 2, and characterized further in that each said tab means includes a portion projecting from the plane of said card to the side thereof on which said blister is affixed, end regions of said projecting portions and said card being so cooperably disposed as to support said package in an upright position on a planar surface.

4. The combination according to claims 1, 2, or 3, and characterized further in that said folded portion of said card is substantially coplanar with said flanged portion of said blister.

5. The combination according to claims 1, 2, or 3, and characterized further in that the recited edge of said folded portion of said card extends over said second part of said flanged portion of said blister.

* * * * *